United States Patent [19]

Wiese

[11] Patent Number: 4,850,403

[45] Date of Patent: Jul. 25, 1989

[54] FUNNEL WITH INDICATOR SHOWING FILLED CONDITION OF SERVICED CONTAINER

[76] Inventor: Patrick C. Wiese, Box 195, Cusick, Wash. 99119

[21] Appl. No.: 186,061

[22] Filed: Apr. 25, 1988

[51] Int. Cl.[4] ..... B65B 39/04; B65B 1/30; B67C 11/00

[52] U.S. Cl. ..... 141/95; 141/300; 141/331; 141/339; 141/340; 73/294; 116/228

[58] Field of Search ..... 141/94–96, 141/331–345, DIG. 1, 297–300, 202, 199–205; 116/227–229; 73/294

[56] References Cited

U.S. PATENT DOCUMENTS

| | | | |
|---|---|---|---|
| 426,667 | 4/1890 | Grissim | 141/94 X |
| 530,690 | 12/1894 | James | 141/94 X |
| 568,411 | 9/1896 | Pratt | 141/300 X |
| 721,870 | 3/1903 | Edison | 141/297 |
| 790,463 | 5/1905 | Talinferro | 141/95 X |
| 868,394 | 10/1907 | Ash | 141/299 |
| 1,333,756 | 3/1920 | Heimgartner | 141/95 |
| 1,938,138 | 12/1933 | Downs | 141/299 X |
| 2,703,670 | 3/1955 | Voight | 141/340 |
| 2,715,488 | 8/1955 | Conlon | 141/95 |
| 2,902,062 | 9/1959 | von Smekal | 141/331 |
| 4,570,823 | 2/1986 | Arabian et al. | 116/229 |

FOREIGN PATENT DOCUMENTS

| | | | |
|---|---|---|---|
| 253142 | 6/1911 | Fed. Rep. of Germany | 141/299 |
| 418571 | 10/1924 | Fed. Rep. of Germany | 141/300 |
| 962222 | 6/1950 | France | 141/335 |
| 1058171 | 3/1954 | France | 141/299 |
| 109360 | 9/1917 | United Kingdom | 141/300 |

*Primary Examiner*—Ernest G. Cusick
*Attorney, Agent, or Firm*—Keith S. Bergman

[57] ABSTRACT

An indicating funnel for filling a container through an opening is formed as two peripherally joined, coaxially arranged funnels, one nested within the other to define a cavity between adjacent funnel walls. A vertically movable fluid level indicator is reciprocatable between the funnels and behind a transparent wall portion of the exterior funnel for viewing between a first lowered position and a second raised postion. The indicator in its lower portion is operably associated with a float positoned within the lowermost portion of the cavity between funnels to indicate fluid level in a serviced container. The exterior funnel, at its intersection with an associated spout, optionally incorporates positoning flanges for maintaining funnel alignment and stability cooperatively with various sized openings. Additionally, the fluid level indicator may include a luminescent feature enabling enhanced visibility and a cap skirt portion lessening spill potential.

11 Claims, 3 Drawing Sheets

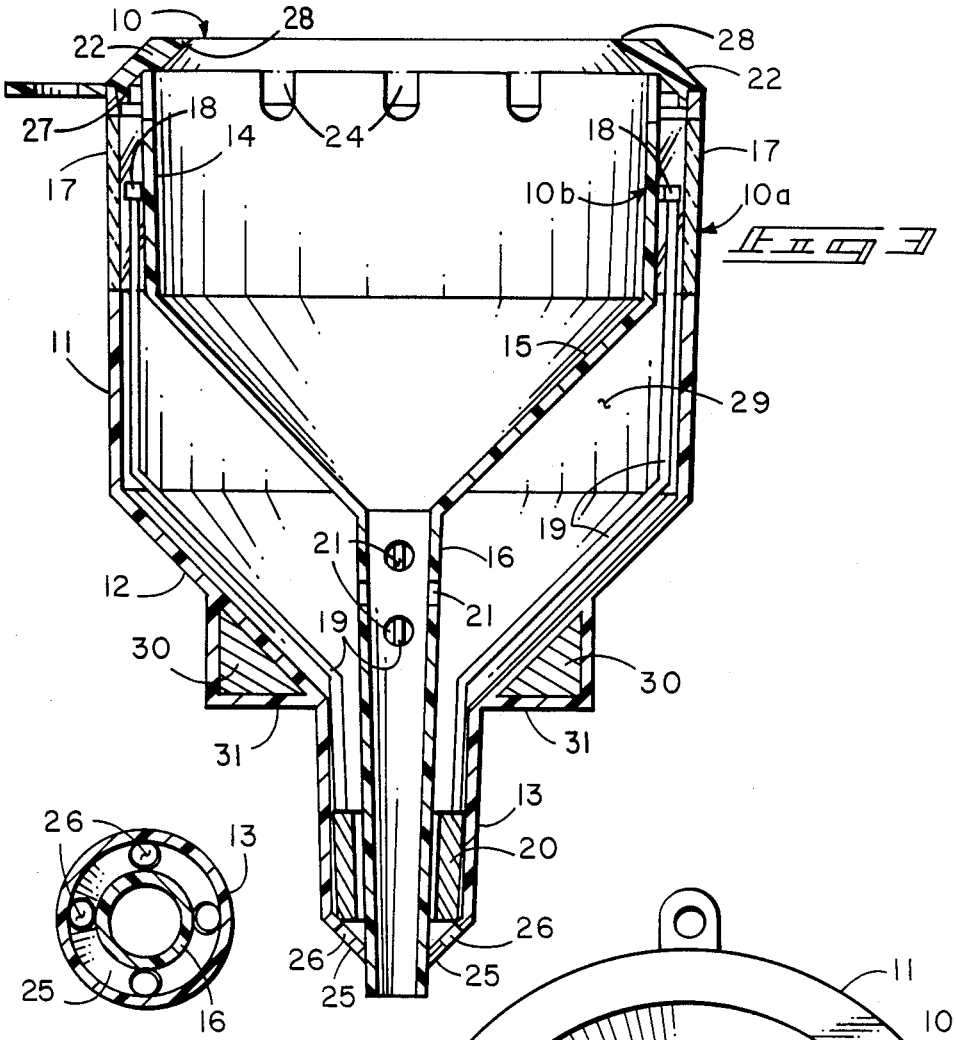
Fig 3
Fig 4
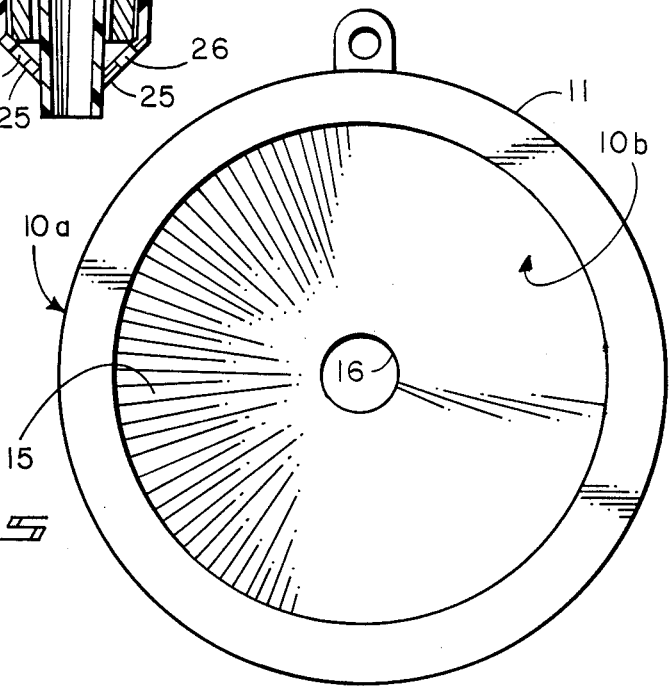
Fig 5

FUNNEL WITH INDICATOR SHOWING FILLED CONDITION OF SERVICED CONTAINER

BACKGROUND OF THE INVENTION

1. Related Applications

There are no applications for patent relating hereto heretofore filed in this or any foreign country.

2. Field of Invention

My invention relates generally to funnels and more particularly to a funnel to visually indicate fluid level in the upper portion of a container being filled.

3. Description of the Prior Art

The use of funnels to aid filling of containers is well known. Funnels are often utilized to fill opaque containers. Overflowing of such containers is an ever present problem as the opaque nature of the container and the funnel itself limit the ability of a user to ascertain when the container being filled is reaching and exceeding capacity. Often spillage, loss of fluid, and contamination of the surrounding environment result from such activities.

Funnels are generally formed with an external configuration including sloping walls directed to a smaller discharge tube, so that the exterior surface of the funnel may form a relatively effective seal in conjunction with an opening in a container to be filled. Accordingly, upon pouring and directing fluid through the interior of such a funnel, venting of the container being filled is not effected, and non-laminar flow, due to "bubbling" of the fluid within the funnel to effect venting, tends to encourage spillage and often an inefficient and somewhat cumbersome filling procedure.

There have heretofore been developed filling funnels including various and sundry indicating and venting mechanisms, but these devices have generally required cumbersome and awkward structures to produce their desirable functions so as to limit the applicability of such devices in many filling operations. Furthermore, these funnel devices that have included indicator mechanisms generally have been of unnecessarily complex structure which makes manufacture and production difficult, and raise cost of the device.

Prior art funnels have frequently included fill indicator structures positioned somewhat medially of the interior conical surface of a funnel. The instant invention overcomes the deficiencies of this type of construction by positioning a fill indicator between spaced surfaces of two coaxial funnels to provide an obstruction-free interior surface enabling more effective positioning of a fill spout within the funnel interior. This structure not only maintains the interior of a funnel free of obstruction but also allows positioning of a variety of filling spouts and free fluid flow therethrough. The absence of obstructions within the funnel interior also allows an increased funnel volume for accepting flow to an ultimate delivery chamber.

To enhance fluid flow from the funnel nozzle to a chamber serviced by my funnel structure, venting of that chamber is effected by venting passages positioned peripherally about the funnel's output spout. These venting channels communicate through the funnel structure to the ambient atmosphere to enable laminar and continuous fluid flow into a chamber.

Prior art funnels have typically been formed of single wall construction. Introduction of various nozzles and spouts within a funnel interior tends to flex and accordingly shorten working life of this funnel type, due in part at least to the general indelicate treatment of this class of device. Furthermore, when indicating structure has been associated with prior art funnels, the positioning of the associated indicator element has been sensitive to the structural integrity of the funnel construction. Accordingly, upon flexure of prior art funnel device, the potential of damage to or binding of an indicating structure, with resultant malfunction of the indicator element, is an ever present problem that defeats the essential purpose of an indicator element associated with a funnel. To this end, the instant invention, by presenting a double wall construction, provides an improved organization of increased structural integrity and stiffness, essentially overcoming the deficiencies of the aforenoted prior art devices.

An additional benefit of the double wall construction of the instant invention enables the indicator mechanism and associated elements to be positioned or nested within the space provided between the double walls to protect the relatively delicate indicator mechanism. The nesting of indicator mechanism between the double walls further eliminates obstructions and obtrusions either within or without the funnel's interior or exterior walls. Accordingly, as funnels are normally dropped and treated somewhat harshly in use, the longevity and effective life of the instant invention is extended considerably over similar prior art devices.

Prior art funnels traditionally are formed with lower external conical surfaces that engage an opening in a container to be filled for seating of the funnel during use. As these funnels taper outwardly of an opening in an upward direction, they have a tendency to wobble about the seating connection to induce spillage of an accidental nature. Since deleterious chemicals, such as petroleum products and the like, are commonly involved in filling operations, a significant environmental hazard may be associated with this activity. To alleviate these problems with my funnel, a stepped region is optionally formed on the instant invention, at the juncture of a conical tapering surface and its associated downwardly directed spout, whereat the stepped region presents a surface to seat onto an associated opening of a container to be filled to thereby reduce the tendency of the funnel to accidentally reposition itself during use in a filling operation and cause spillage. The seating surface is preferably created by plural flanges which also aid in venting the container being filled. Optionally the stepped region may include a magnet to further enhance positional stability.

The instant invention also may include a luminescent indicator element to aid use in dimly lit working environments. Additionally, a filtration screen may be incorporated and positioned interiorly of the funnel, proximate the output spout, to prevent debris from passing therethrough, if desired.

My invention resides not in any one of these features per se, but rather in the particular combination of all of them as herein disclosed and claimed, and it is distinguished from the prior art in this particular synergetic combination of all of its structures that create the functions necessarily flowing therefrom.

SUMMARY OF INVENTION

The instant invention comprises a multi-walled funnel formed by spaced inner and outer coaxially oriented funnels that create a chamber therebetween. A vertically movable float is positioned in a lower position, proximate the lower terminal end of the funnel and in the chamber defined between the downspouts thereof. An indicator linkage is secured to the float at a first lower end and to an indicator element at a second upper end, behind a transparent window defined in the outer funnel wall in an upper portion of the funnel to allow viewing. An inwardly extending annulus at the funnel top aids in preventing splashing of liquids being dispersed through the funnel.

Venting of fluid directed through my funnel is provided by vertically orientated porting formed in a web between the inner and outer funnel spouts to vent entrapped air in a container to the chamber between funnels and thence outwardly to the ambient atmosphere. Optionally included in my funnel structure is a luminescent indicator element and a supportative portion at the intersection of the spout and conical transition portion of the funnel. A filtration screen also may be positioned proximate the output spout.

In creating such a device, it is:

A principal object of my invention to create a funnel including indicator means to annunciate relative fluid levels within an associated container as they near a filled level.

A further object of my invention to provide such a device that includes two coaxially arranged funnels at a spaced distance from each other to define a space therebetween wherein a fill level indicator means is arranged and reciprocatably movable.

A further object of my invention to provide such a device wherein a float is positioned in a space defined between the coaxially arranged funnel spout walls for reciprocating movement effected by a fluid contact in the container being filled to responsively move the indicator means.

Yet another object of my invention to provide such a funnel arrangement wherein indicating means are positioned behind a transparent window portion of an upper section of the exterior funnel element.

A further object of my invention to provide such an indicator funnel structure wherein the indicating portion may be luminescent.

A further object of my invention to provide such an indicator funnel arrangement wherein venting of a container being filled is effected by porting passing entrapped air between spaced walls of the coaxially arranged funnel elements.

A further object of the invention to provide an annular support for positioning on a container opening to impart stability to the funnel during use.

A still further object of my invention to provide such a device that is of new and novel design, of rugged and durable nature, of simple and economic manufacture, and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one practical and preferred embodiment being illustrated in the accompanying drawings, as is required.

BRIEF DESCRIPTION OF DRAWINGS

In the accompanying drawings which form a part hereof, and wherein like numbers of references refer to similar parts throughout:

FIG. 3 is a vertical cross-sectional view through the invention shown in FIG. 1, taken along the line 3—3 in the direction indicated by the arrows.

FIG. 4 is a horizontal cross-sectional view through the lower portion of the downspout of FIG. 1, taken along the line 4—4 in the direction indicated by the arrows, to show the venting structure.

FIG. 5 is an orthographic top view of the device of FIG. 1, showing especially the splash guard.

DESCRIPTION OF THE PREFERRED EMBODIMENT

Figures 1, 2, 8:
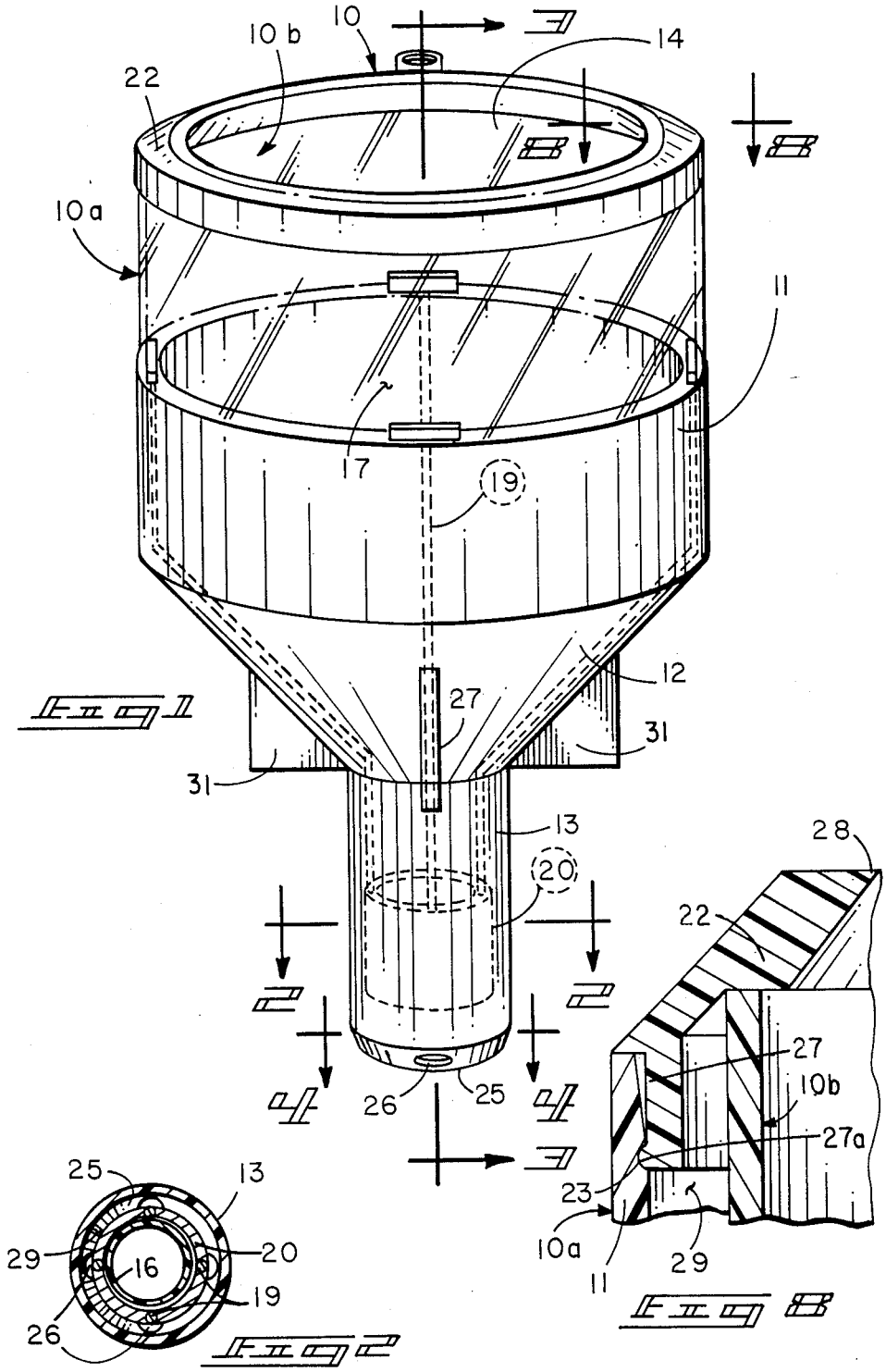
FIG. 1 is an isometric view of my invention showing various of its parts, their configuration and relationship with the float and associated indicator linkage structure shown in dashed phantom outline.
FIG. 2 is a horizontal cross-sectional view through the downspout of my invention, taken along the line 2—2 of FIG. 1 in the direction indicated by the arrows.
FIG. 8 is an enlarged, partial cross-sectional view through the interconnection of the upper portions of the funnels and the annular splash ring, taken on the line 8—8 of FIG. 1 in the direction indicated by the arrows.

My invention comprises generally funnel 10 formed with an integrally associated indicator to visually indicate fluid levels within a container being serviced by the funnel.

Funnel 10 is a compound structure including outer funnel **10*a* comprising axially aligned outer first cylindrical wall 11 integrally formed to depending first conical wall 12 which interconnects with first terminal spout 13. Axially aligned and interiorly oriented inner funnel 10*b*, of similar but smaller configuration, is formed by second cylindrical wall 14 contiguously joined to second conical wall 15 which terminates in second discharge spout 16. Upper web 22 and lower web 25 interconnect the inner and outer funnels at their vertical terminal portions and secure them together in axial alignment to provide a unitary structure. The inner and outer funnels 10*a* and 10*b* constitute surfaces that define space or chamber 29** therebetween as determined by the relative positioning and particular configurations of the funnels.

In the funnel species illustrated in FIG. 1, upper web 22 is a releasably positionable annular element defining depending cylinder 27 which in its lower portion may have annular protuberance **27*a* carried in groove 23 defined in the upper portion of the inner surface of outer funnel, spacedly below its upper edge. The web defines inwardly extending upper portion 28 to form a splash shield that aids in maintaining fluid within the funnel interior. The upper portion of inner funnel 10*b* defines vent orifices 24 that extend below the annular upper web to vent chamber 29**, between inner and outer funnels, to the ambient atmosphere.

Transparent viewing window 17 is defined in the upper portion of cylindrical surface 11 of the outer funnel to enabler viewing of indicators 18 carried between first and second funnel walls 11 and 14. The indicators 18 are of convenient configuration to indicate fluid level of a conventional container (not shown)

utilizing funnel 10 in a typical manner for filling purposes, with spout 13 positioned interiorly of the container being serviced through a fill opening. Optionally, indicators 18 may be coated, impregnated, or formed of a luminescent substance enabling viewing of the indicator in dimly lit environments.

Plural support fins 31 are formed immediately above the juncture of outer conical wall 12 with spout 13 to extend radially outwardly in spaced array. The support fins provide lower coplanar surfaces perpendicular to the funnel axis to support the funnel in an appropriately sized orifice for use. The support fins may include magnetic material 30 in their structure to aid in positionally maintaining the funnel adjacent magnetically permeable material defining orifices whereon the funnel is supported.

Associating linkage 19 operatively connects indicator 18 with float 20. This linkage is so configured that the entire indicating assembly comprising indicator 18, associating linkage 19 and float 20 are completely enclosed in chamber 29 defined between the inner and outer funnels. In the instance illustrated, the associating linkage comprises diametrically opposed rod-like elements of appropriate configuration. The walls defining chamber 29 protect the indicating assembly from damage from adverse handling and limit exposure to elements that may potentially damage the operation or effectiveness of the indicating assembly.

Optionally defined in second discharge spout 16 are plural orifices 21 which enable fluid to more readily discharge into a container to be filled and not adversely effect action of float 20 in its reciprocating movement. Orifices 21 are limited in combined area to discharge therethrough a volume of fluid somewhat less than the capacity of lower vent openings 26, to allow discharge of entrapped container air and avoid interference with that function. Vent openings 26 defined in web 25 enable discharge of entrapped air within a container to be directed through space 29 and discharged through upper vent openings 24 in the top portion of the inner funnel cylinder 14 to allow a continuous and laminar flow of liquid through funnel 10 and discharge spout 16 of the inner funnel. Passage of air through lower vent openings 26 and ultimately through upper vent openings 24 is desirable to eliminate pressure build-up within a container to be filled to avoid spill of fluid from within the confines of the inner funnel by forcing entrapped container air to migrate upwardly through that fluid, usually in a bubbling fashion. This also avoids false indicator readings that might be caused by entrapped container air.

Figure 6:
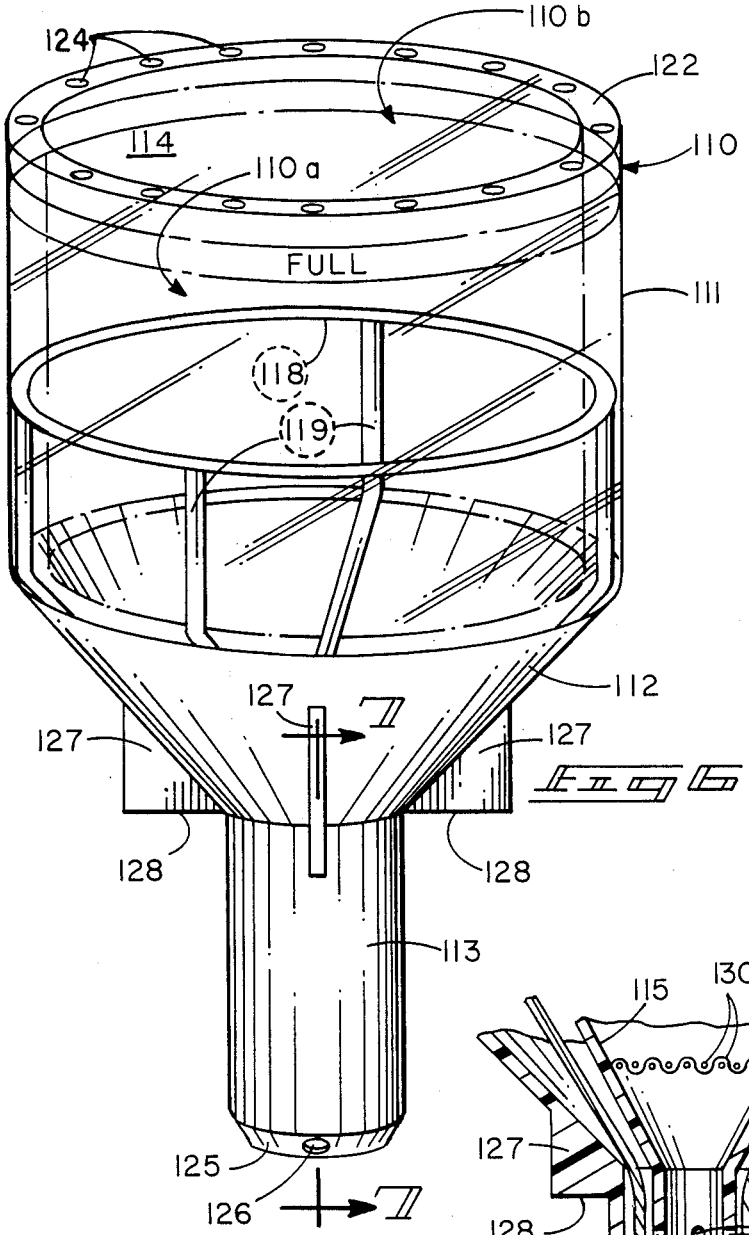
FIG. 6 is an isometric view of a species of the instant invention, with a transparent portion defined in the outer funnel.
Figure 7:
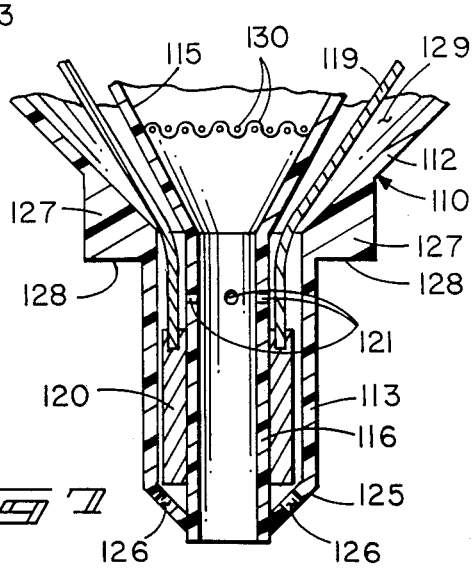
FIG. 7 is a partial, vertical cross-sectional view through the downspout of the device of FIG. 6, taken along the lines 7—7 in the direction indicated by the arrows.

FIGS. 6 and 7 illustrate a modification embodying a second species of the instant invention. Funnel 110, of a similar construction to the first species set forth in FIGS. 1 through 5, comprises outer funnel 110*a* formed by upper cylindrical wall 111 and conical outer wall 112, terminating in outer spout 113; and inner axially oriented funnel 110*b* formed by interconnecting inner cylindrical wall 114, inner conical wall 115, and inner spout 116. Optional spout openings 121, as in the first embodiment, may be defined in discharge spout 116 in a manner and for purposes as set forth in the embodiment of FIG. 1. The inner and outer axially oriented funnels are integrally associated by upper web 122 and lower web 125, with lower vent openings 126 defined in lower web 125 and upper vent openings 124 defined in circumferential spaced array in upper web 122. As in the first embodiment, vent openings 126 and 124 enable entrapped contained air to discharge through internal chamber 129 of funnel 110.

Illustrated in the embodiment of FIGS. 6 and 7 are support fins 127 formed at the juncture of conical wall 112 and spout wall 113 to extend radially outwardly therefrom in spaced array. The support fins are preferably three in number and provide coplanar support surfaces 128 for positioning on an opening of a container to enhance stability of the funnel apparatus in use. The support fins may optionally include magnetic material either within their structure or upon their surface to aid in positionally stabilizing my funnel when used with container orifices made of magnetically permeable material.

Of further optional use in either embodiment of the instant invention is screen filter 130, positioned within inner concial wall 115 and having a mesh size preselected to depend on the type of fluid to be introduced and contaminant size to be trapped by screen. As may be appreciated, screen filter 130 may be removable for cleaning and to enable various mesh sizes of filter 130 to be utilized for application in filtering of various classes of fluids and contaminants.

In lieu of transparent window 17, as utilized in the first embodiment of my funnel, the species of FIGS. 6 and 7 presents an upper outer cylindrical wall 111 formed of transparent material to enable 360 degree observation of the positioning of vertically movable indicator ring 118. Second funnel wall 114 may also be transparent, as illustrated, to aid in visually determining presence and quantity of fluid within second funnel 110*b*, as well as allowing observation of indicator ring 118, but only the exterior wall 111 need be transparent.

Indicator ring 118 is mechanically associated with float 120 by a plurality of paired links 119 secured to float 120 and to the indicator ring 118 in spaced positions about the circumference of the ring to equalize weight distribution of the ring upon the float and prevent skewing or canting of the float. In this manner, the indicator assembly comprised of the various elements 118, 119 and float 120 is rotatable within space 129 defined between the inner and outer coaxial funnels. Equilibrium of float 120 is also more readily established by equal weight distribution imposed by ring 118 through the four equally spaced link pairs 119 communicating with the float. To further stabilize the float, if necessary, a chamber (not shown) may be defined in a symmetrical configuration in the float structure and partially filled with a heavy material such as fine lead shot or mercury, maintained within weight limits so as not to disable the float.

In either embodiment of my funnel, the indicating organization comprising indicator, linkage, and float are vertically reciprocatable between the spacing defined within the inner and outer funnel structures responsive to fluid contact by the float in a container being filled.

The optional use of support structure 127 is applicable to container openings of diameters less than that of the support step, but otherwise, the respective conical surfaces 12 and 112 enable positioning of funnels 10 and 110 in a nested sealing engagement with openings, limited only by the outside diameters of the respective funnels.

In the embodiments depicted by numerals 10 and 110, the funnel arrangements optionally may include indicator elements 18 and 118 formed with a luminescent material to aid use in dimly lit environs. Furthermore, indicia may be imposed either upon window 17 or upon surfaces 111 and/or 114 for graphic indication of measure indicia of filling within an associated container.

Either species of my funnel operate in similar fashion. For operation, a funnel is formed as specified and manually established in an orifice defined by a container to be serviced in a somewhat vertical orientation with spout 13 extending downwardly through the orifice and into the upper portion of a serviced container. Fluid to be introduced into the serviced container is poured into inner funnel 10*b* or 110*b*, as the case may be, in the same fashion as with operation of ordinary funnels heretofore know. As the serviced container is filled the fluid level in the container rises until it contacts the spout of my funnel, and as that fluid level continues to rise, it will move upwardly through orifices 26 or 126 in lower web element 25 or 125 and into chamber 29 or 129 defined between the inner and outer funnels. As the rising liquid contacts float 20 or 120, as the case may be, the float is moved upwardly to correspondingly move indicator 18 or 118 upwardly to indicate filling of the serviced container. Normally some indicia will be carried by the upper portions of a funnel to indicate a full or substantially full condition of the serviced container, that is, when the bottom of float 20 or 120 moves upwardly to the plane through fins 31 or 127.

It should be understood that while the outer configurations of funnels 10 and 110 are advantageously presented, these configurations may vary without any significant departure from the scope or essence of the instant invention. For example, conical surfaces 12 and 112 may be configured of the various tapering shapes and with or without the symmetrical configuration of a conical surface, which is preferred only for convenience of manufacture and use. Accordingly, the upper cylindrical surfaces and spouts may also be of varying cross-sectional shape.

The foregoing descriptions of my invention is necessarily of a detailed nature so that a specific embodiment of it might be set forth as required, but it is to be understood that various modifications of detail, rearrangement and multiplication of parts might be resorted to without departing from its spirit, essence of scope.

Having thusly described my invention, what I desire to protect by Letters Patent, and what I claim is:

1. A funnel for indicating fluid level in the upper portion of a container being filled thereby, comprising:

an outer funnel portion, including a first wall portion for acceptance of a fluid joined to a first spout portion, defining a first surface, and an inner funnel portion, including a second wall portion joined to a second spout portion for directing discharge of fluid, defining a second surface, and positioned within the outer funnel portion to define a space between said first and second surfaces, float means including a float axially displaceable in said space between said first and second surfaces, for movement relative to said spout portions responsively to contact with an underlying fluid level, and indicator means, positioned within said space between said first and second surfaces, structurally communicating with said float means for indication of displacement of the float axially of said inner and outer funnel portions.

2. A funnel as set forth in claim 1 wherein said inner and outer funnel portions are integrally associated by webbing means including an upper web integrally secured between terminal upper peripheries of said inner and outer funnel portions, and a lower web integrally secured between lower peripheries of said inner and outer funnel portions.

3. An indicator funnel as set forth in claim 2 wherein vent openings are formed in the upper inner funnel portion and lower web.

4. The invention of claim 2 wherein the upper web includes an annular splash shield extending a spaced distance inwardly from the upper terminal periphery of the inner funnel portion.

5. An indicator funnel as set forth in claim 1 wherein said indicator means comprises an indicator bar positioned for reciprocal motion in said space defined between the first and second surfaces, remote from the space.

6. An indicator funnel as set forth in claim 5 wherein said indicator bar carries a luminescent material.

7. An indicator funnel as set forth in claim 5 wherein said indicator bar is formed as a ring encircling said inner funnel portion at a spaced distance therefrom.

8. An indicator funnel as set forth in claim 1 wherein the first and second surfaces are determined by first and second surfaces of revolution defined above an axis common to both said first and second funnel portions.

9. An indicator funnel as set forth in claim 1 wherein the outer funnel portion is substantially coextensive in length with said inner funnel portion.

10. An indicator funnel as set forth in claim 1 wherein said first surface includes a transparent window for viewing of said indicator means.

11. An indicator funnel as set forth in claim 1 wherein a planar surface is formed on the exterior of the outer funnel portion, proximate the intersection of said first wall and spout portions.

* * * * *